United States Patent [19]

Bond

[11] 4,351,455

[45] Sep. 28, 1982

[54] FINGER-ACTUATED SLIDEABLE DISPENSING VALVE

[75] Inventor: Curtis J. Bond, Marion, Ohio

[73] Assignee: Liqui-Box Corporation, Worthington, Ohio

[21] Appl. No.: 160,981

[22] Filed: Jun. 19, 1980

[51] Int. Cl.[3] ..... B65D 25/40

[52] U.S. Cl. ..... 222/153; 222/522

[58] Field of Search ..... 222/153, 519, 522, 523, 222/524

[56] References Cited

U.S. PATENT DOCUMENTS

| | | | |
|---|---|---|---|
| 1,940,719 | 12/1933 | Le Blanc | 222/522 |
| 3,173,579 | 3/1965 | Curie et al. . | |
| 3,223,117 | 12/1965 | Curie et al. | 222/522 |
| 3,430,824 | 3/1969 | Conners et al. | 222/523 |
| 3,493,146 | 2/1970 | Conners et al. . | |

FOREIGN PATENT DOCUMENTS

| | | | |
|---|---|---|---|
| 2329530 | 5/1977 | France | 222/153 |
| 617479 | 2/1961 | Italy | 222/522 |

*Primary Examiner*—Joseph J. Rolla

*Attorney, Agent, or Firm*—William V. Miller

[57] ABSTRACT

A dispensing valve made as a separate unit to be mounted on a flexible bag in box spout and including a slide valve member slideably disposed in a guide sleeve member for axial movement between closed sealing position and opened dispensing position. A locking arrangement is provided for keeping the slide in fully closed position and to prevent the slide from being accidentally opened. It also includes a sealing arrangement at the outer end of the slide member and guide sleeve for sealing the slide member when it is in closed position. It further includes a flange arrangement on the slide member and guide sleeve member to facilitate gripping by the fingers to push the slide manner into closed position in the guide sleeve member.

4 Claims, 10 Drawing Figures

FIG. 8
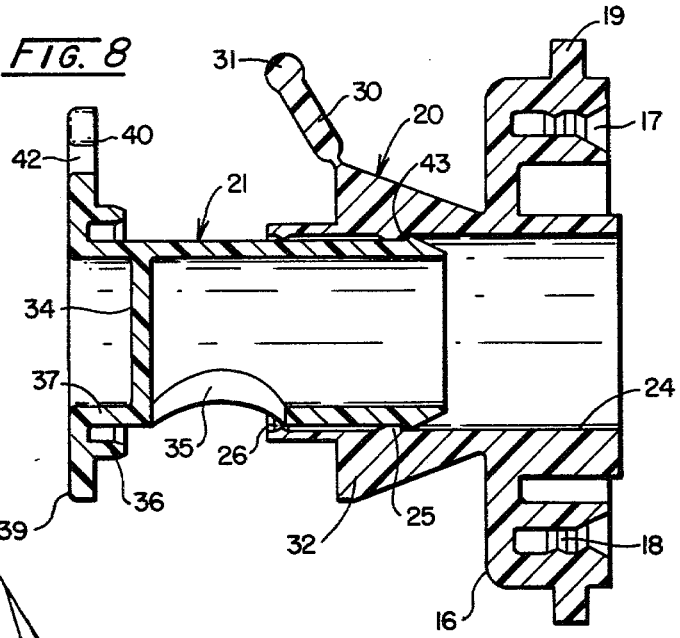
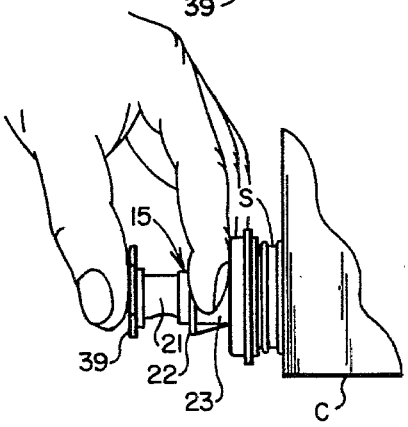
FIG. 10
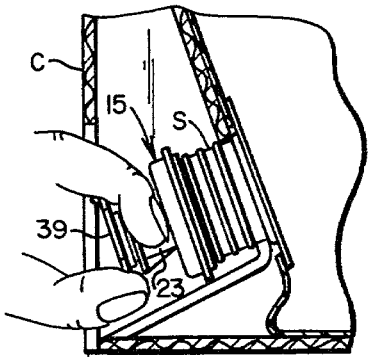
FIG. 9

FINGER-ACTUATED SLIDEABLE DISPENSING VALVE

BACKGROUND OF THE INVENTION AND PRIOR ART

This invention deals with the type of valve for controlling dispensing of the contents from a flexible plastic bag of the type usually disposed in a box commonly made of corrugated board. The valve is carried by the spout of the bag and when the contents are to be dispensed, a suitable opening is formed in a wall of the box and the spout is manipulated into the opening and locked in dispensing position on that wall. Dispensing valves of this general type are disclosed in U.S. Pat. Nos. 3,173,579 and 3,493,146, the former showing a valve as part of the spout and the latter as a separate unit from the spout.

SUMMARY OF THE INVENTION

The present invention provides a dispensing valve which is made as a separate unit for removably mounting on the bag spout. It comprises an axially-outwardly projecting guide sleeve member in which a slide valve member is mounted for axial sliding movement. This slide member is of tubular form, open at its inner end and closed at its outer end, with a radially-directed outlet port near its outer end. This outlet port is covered by the guide sleeve member when the valve member is in its inner position but is exposed for dispensing when in its outer position, the slide being rotatable in the sleeve so that the dispensing port can be directed downwardly.

To prevent accidental movement of the slide member in the guide sleeve to its open position, especially during pulling of the valve and spout from the box, and to properly locate the dispensing outlet port angularly, a locking arrangement is provided at the outer end of the slide valve member and guide sleeve so as normally to keep the slide member in fully closed selected angular position. A sealing arrangement is provided between the outer end of the guide sleeve member and the slide valve member, when in closed position, to reduce oxygen permeation into the bag and thereby increase shelf-life of the contents of the bag. Also, a special flange arrangement is provided at the outer ends of the guide sleeve member and slide valve member to facilitate actuation of the valve by the fingers of one hand.

BRIEF DESCRIPTION OF THE DRAWINGS

The best mode contemplated in carrying out this invention is illustrated in the accompanying drawings in which:

FIG. 8 is an axial sectional view, showing the valve unlocked and opened.

FIG. 9 shows the valve on the spout of a bag in a box as it is being moved to dispensing position.

FIG. 10 is a schematic view showing the use of the fingers on closing the valve, the valve being shown in dispensing position out of the box but disposed on a wall thereof.

DETAILED DESCRIPTION OF THE DRAWINGS

Figure 1:
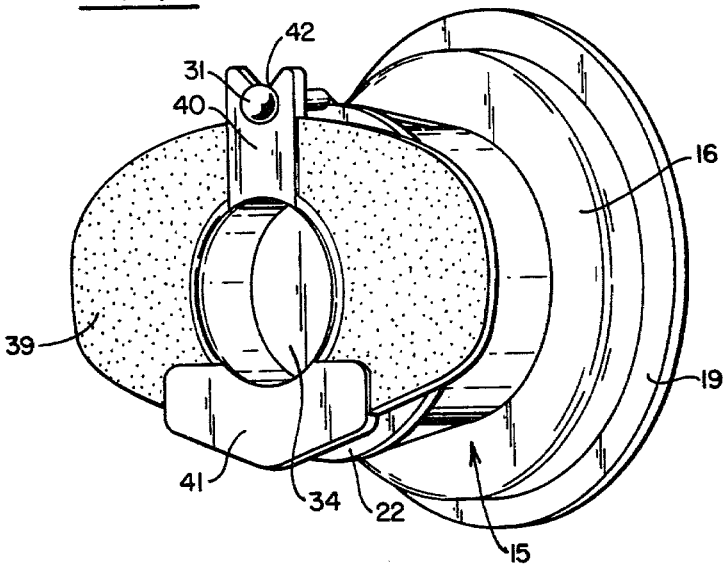
FIG. 1 is a perspective view of the valve of this invention, showing it locked in closed position.

With specific reference to the drawings, the valve is indicated generally by the numeral 15 and is shown as a separate unit adapted to be mounted on the spout S, shown in FIGS. 9 and 10, of a flexible bag B which is usually disposed in a corrugated box or container C, as disclosed in U.S. Pat. No. 3,173,579. During storage or shipping, the valve 15 is within the closed box C, as shown in FIG. 9, but when it is desired to dispense the contents of the bag B, the valve-carrying spout S is manipulated into and locked in dispensing position in an opening provided by a tear-out tab in the end of the box as indicated in FIG. 10. The bag is usually made of flexible plastic film and the spout S and cap 15 of a suitable semi-rigid plastic material.

The valve itself includes a substantially disk-like cap portion 16 which is adapted to be removably mounted on the spout S. The cap portion is provided with an annular groove 17 which opens outwardly to receive the lip of the spout and which has annular sealing shoulders 18 therein that cooperate with shoulders on the spout to provide a "snap" fit and frictional seal. The cap also has a peripheral flange 19 which facilitates removal of the valve 15 from the spout S and reapplication, for example, during the filling operation.

Carried integrally by the cap portion 16 is the guide sleeve member 20 which is disposed concentrically thereof and has a cylindrical socket or passage 24 extending completely therethrough for slideably and rotatably receiving the annular tubular slide valve member 21. Spaced axially outwardly from the cap 16 is a peripheral flange 22 which extends substantially radially outwardly from the tubular guide member 20. This provides a sufficient annular space 23 for insertion of the fingers when closing the valve, as indicated in FIG. 10 or when manipulating it in withdrawing the valve from the box C to dispensing position as shown in FIG. 9. Spaced inwardly from the outer end of the passage 24 on the wall thereof, is an annular stop 25 and towards the outer end extremity and on the inner surface thereof, is a small annular sealing shoulder 26. This extremity of the member 20 is made relatively thin so it is comparatively flexible. Carried at the outer edge of the flange 22 of the member 20 is a latch tab 30 which is connected thereto at an integral flexible joint 29. The outer end of the tab 30 is provided with an enlarged stop or retaining ball portion 31. Reinforcing ribs or gussets 32 are provided at diametrically opposed points between the flange and the exterior tubular guide sleeve member 20, and the latch tab 30 is preferably connected to member 20 at one of these ribs. These ribs extend into finger-receiving space 23 but will not interfere with the positioning of the fingers therein as shown in FIGS. 9 and 10.

Figure 2:
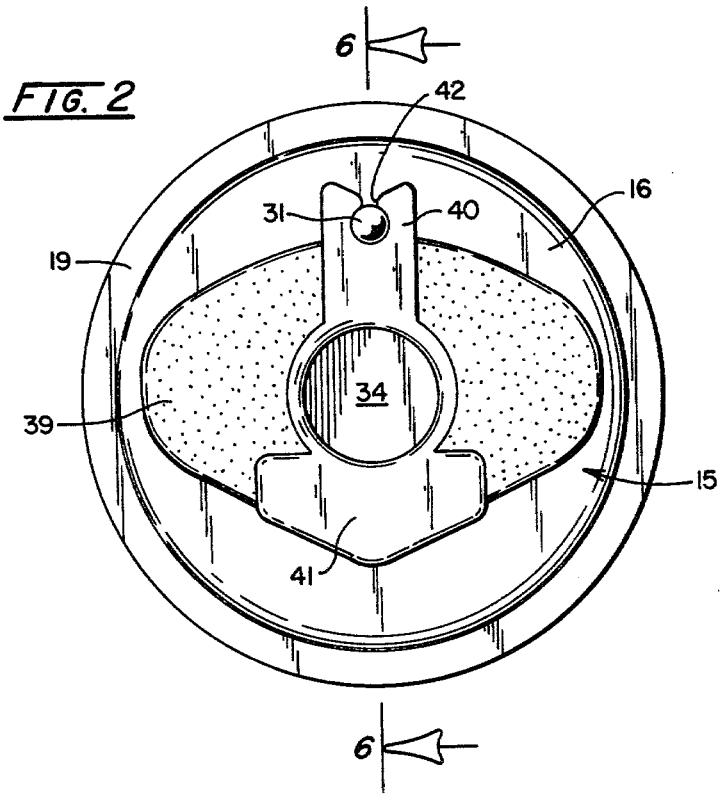
FIG. 2 is a face view of the valve.
Figure 3:
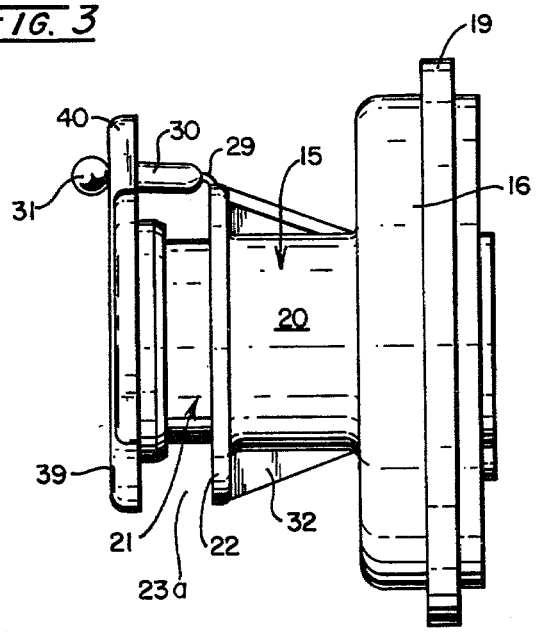
FIG. 3 is a side elevational view of the valve.
Figure 4:
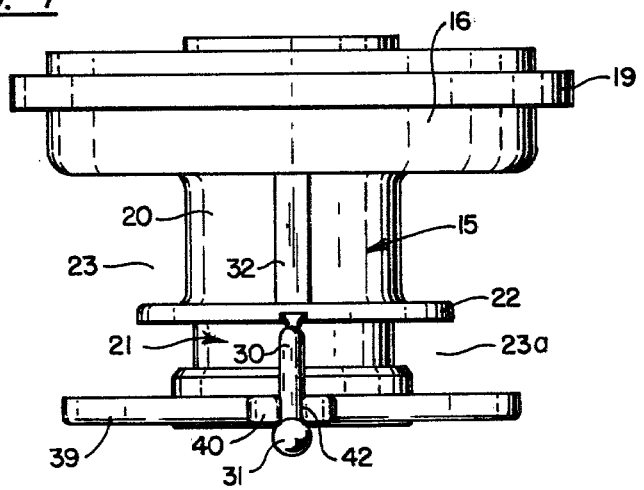
FIG. 4 is a top view of the valve.
Figure 5:
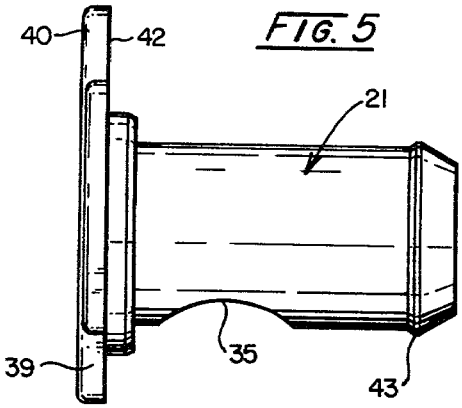
FIG. 5 is a side elevational view of the slide valve member.
Figure 7:
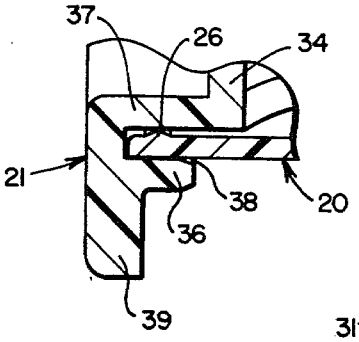
FIG. 7 is an enlarged detailed sectional view of the sealing arrangement at the outer end of the valve.
Figure 6:
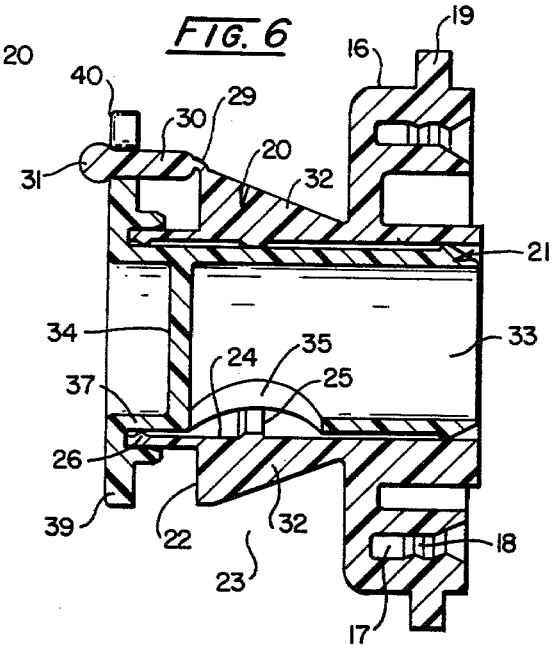
FIG. 6 is a sectional view taken along line 6—6 of FIG. 2.

The slide valve member 21 is mainly of hollow annular tubular form and is slideably as well as rotatably carried by the guide sleeve member 20. The dispensing passage 33 therein is open at its inner end but closed at its outer end by an outer transverse wall 34. A dispensing outlet port 35 leads radially from the dispensing passage 33 in the valve member 21 adjacent the outer wall 34 which it will be noted is offset inwardly relative to the outer extremity of the valve member. The outer extremity of the valve 21 is provided with a diametrically-projecting flange 39 of substantially oval form, as shown in FIGS. 1 and 2, which is formed integral with the outer end of the valve member 21. On the inner surface of this flange, as shown best in FIGS. 6 and 7, is an axially inwardly-extending skirt 36. This skirt 36 is concentric with and cooperates with the skirt portion 37 of valve member 21 outwardly beyond wall 34, to provide an axially inwardly-opening annular groove 38 for receiving the outer relatively flexible extremity of guide sleeve member 20 when valve member 20 is pushed into closed position, at which time the outlet 35 is covered by guide sleeve member 20, as shown in FIG. 6. At this time, the annular sealing shoulder 26 is in tight frictional sealing engagement with skirt 37 and the outer annular surface of the end of member 20 is forced against annular skirt 36, as shown best in FIG. 7. Also, at this time, flange 39 is spaced axially-outwardly from flange 22 to provide a finger-receiving space 23*a* therebetween.

To hold the slide valve member 21 in its innermost closed position in guide sleeve member 20 and to properly locate the member 21 angularly or rotatively in member 20 so that outlet 35 is directed properly, that is, downwardly, a keeper lug 40 is formed on the flange 35 diametrically opposite the outlet 35. Consequently, if lug 40 extends upwardly, outlet 35 will be directed in the proper direction, downwardly. The lower portion 41 of the flange 39 may be so formed that it, along with the upper lug 40, produces a downwardly-directed arrow. The lug 40 has a keeper notch 42 of V-form opening upwardly which will receive the latch 30 when the valve is moved to its fully closed position shown in FIGS. 1 to 4 and 6. The flexible latch tab 30 is swung down across space 23*a* into the keeper notch 42 and is of such length that the enlargement or ball portion 31 thereon will frictionally engage the keeper lug 40 and may even stretch slightly, thus the tab 30 will be held in locking position.

To open the valve and dispense the contents of the bag B, the ball 31 of the latch tab 30 can be engaged with the thumb of one hand and pushed outwardly out of the keeper notch 42 to release the slide valve member 21. Then the fingers of the same hand can be inserted in the space 23*a*, behind the flange 39, between it and flange 22, and the valve pulled outwardly, as indicated in FIG. 8, to expose the dispensing outlet 35. Outward axial movement of the valve member 41 is limited by an annular stop shoulder 43 on the exterior of member 41, at its inner extremity, contacting the annular stop shoulder 25 on the interior of sleeve guide 20 as shown in FIG. 8.

Thus, this invention provides means for latching the slideable valve member 21 in closed position to prevent accidental opening. This is especially important in pulling the valve assembly 15 from the position of FIG. 9 within the box C to the extended dispensing position shown in FIG. 10, where it is on spout S that is locked on the wall of the box C, during which the valve slide member 21 might otherwise be accidentally pulled outwardly to open position from the guide sleeve 20. The latching means also locates the dispensing outlet 35 so that it is directed downwardly and this is indicated by the pointer 41. Withdrawing of the valve assembly 15 from the box to dispensing position is facilitated by finger-receiving groove 23 between cap portion 16 and flange 22. The flanges 22 and 39 facilitate closing and opening of the valve, the flange 22 being especially useful in pushing the valve into closed position as illustrated in FIG. 10. When the valve is closed, the relatively flexible outer end of guide sleeve 20 is forced into the receiving groove 38 of the valve member 21 so that the annular sealing rib or shoulder 26 will tightly contact with the outer surface of the skirt 37 and the outer surface of sleeve 20 will tightly contact with the inner surface of the skirt 36. Thus, a better seal will be provided to prevent permeation of oxygen into the bag B and increased shelf-life for its contents.

Having thus described this invention, what is claimed is:

1. A dispensing valve assembly adapted to be removably mounted on a spout carried by a flexible bag which is intended for disposition in a box for movement of the valve assembly between a non-dispensing position and a dispensing position locked in an opening in a wall of the box comprising: a cap having a body of substantially disc-like form with means for removably mounting it on the spout, an annular tubular guide sleeve formed concentrically on the disc-like body and projecting axially outwardly therefrom substantially nornal thereto, said guide sleeve being of less diameter than the disc-like cap body and having a cylindrical socket extending completely therethrough and through the cap body, a peripheral radially-extending flange spaced axially-inwardly of the outer end of said guide sleeve to provide an axially-outwardly extending annular flexible sealing skirt with an outer extremity, said peripheral flange being spaced axially-outwardly from the disc-like cap body to provide an annular finger-receiving space therebetween; an annular tubular slide valve member mounted for axially sliding and rotating movement in said guide sleeve and being of hollow form to provide a dispensing passage with an open axial inner end, an outer transverse wall closing said dispensing passage adjacent an outer extremity of the valve member but spaced therefrom to provide an outwardly-extending annular inner skirt at said outer extremity, a peripheral radially-outwardly extending flange on said outer extremity of said valve member, said last-named flange having an inwardly-extending annular outer skirt which is concentric with said outwardly-extending inner skirt to form an inwardly-opening annular sealing groove for receiving said flexible outwardly-extending sealing skirt on the guide sleeve when the valve member moves axially inwardly on the guide sleeve into closed position as determined by said extremity of the sealing skirt contacting said peripheral flange on the valve member in the groove, interengaging stop means between the valve member and the guide sleeve to limit axial outward sliding movement of the valve member relative to said sleeve into opened position, said peripheral flange on the outer extremity of said valve member extending radially outwardly thereof over the said peripheral flange on the guide sleeve and being spaced axially-outwardly thereof when the valve member is in its inner closed position on the guide sleeve to provide a finger-receiving space between the two flanges, said valve member having a dispensing port leading radially therefrom just axially inwardly of said transverse wall which is axially within the guide sleeve when the valve member is in closed position but is axially beyond the guide sleeve when the valve member is in opened position as determined by said stop means; said interengaging stop means comprising an annular stop shoulder on the exterior surface of the tubular valve member at its inner extremity and a cooperating annular stop shoulder on the inner surface of said guide sleeve axially adjacent said radially-extending peripheral flange on said guide sleeve so as to position the dispensing port of the valve member beyond the outer extremity of the flexible sealing skirt of the guide sleeve when the said stop shoulders are engaged; an annular sealing shoulder on the inner surface of said annular flexible sealing skirt of the guide sleeve for engaging with the adjacent outer surface of said inner skirt of the valve member when the valve member is moved axially inwardly of the guide sleeve into closed position with said flexible sealing skirt extended axially outwardly into said annular sealing groove; a latch tab having an inner end flexibly secured to said peripheral radially-extending flange on the guide sleeve and having a retainer enlargement on its outer end; said peripheral radially-extending flange on the outer extremity of said valve member having a radially-directed keeper notch for receiving said flexible tab with the retainer enlargement outwardly of the flange to hold said valve member in its closed position within the guide sleeve, said dispensing port being formed in said valve member at a point diametrically-opposed to said keeper notch so the latch tab will also locate the dispensing port in proper dispensing position angularly.

2. A dispensing valve assembly according to claim 1 in which the means for removably mounting the cap body on the spout comprises a double annular concentric skirt on said cap body surrounding concentrically an inner end of said guide sleeve providing an inwardly-opening annular groove for receiving and frictionally engaging the lip of a spout.

3. A dispensing valve assembly according to claim 1 having reinforcing ribs between the guide sleeve flange and the guide sleeve at diametrically-opposed points, said latch tab being a strip flexibly connected at its inner end to said flange at one of said ribs, and the retainer enlargement on its outer end being ball-shaped; said keeper notch being formed as a V-notch in a keeper lug extending radially on said flange.

4. A dispensing valve assembly according to claim 3 in which said flange which has the keeper notch lug thereon also has a pointer projecting radially therefrom at a diametrically-opposed point to indicate the angular location of said dispensing port.

* * * * *